United States Patent [19]

Mista

[11] 4,236,739

[45] Dec. 2, 1980

[54] THREAD INSERTER AND BRAKING MECHANISM FOR A KNOTTING APPARATUS USED ON SPOOLING MACHINES

[75] Inventor: Kresimir Mista, Obertshausen, Fed. Rep. of Germany

[73] Assignee: Karl Mayer Textilmaschinenfabrik GmbH, Obertshausen, Fed. Rep. of Germany

[21] Appl. No.: 940,586

[22] Filed: Sep. 8, 1978

[30] Foreign Application Priority Data

Sep. 16, 1977 [DE] Fed. Rep. of Germany ..... 2741786

[51] Int. Cl.[3] ..... B65H 69/04

[52] U.S. Cl. ..... 289/2

[58] Field of Search ..... 289/2

[56] References Cited

U.S. PATENT DOCUMENTS 2,246,217 6/1941 Noling ..... 289/2 X 3,406,994 10/1968 Duncker et al. ..... 289/2

FOREIGN PATENT DOCUMENTS 2642268 3/1978 Fed. Rep. of Germany ..... 289/2

*Primary Examiner*—Louis Rimrodt

*Attorney, Agent, or Firm*—Omri M. Behr; Martin Sachs

[57] ABSTRACT

A thread inserter and braking mechanism for a knotting apparatus used on spooling machines includes thread inserting and braking arms disposed on either side of the binding heads and external to the housing mounting the knotting apparatus. Brake pads disposed on either side of the housing cooperate with the thread inserter and braking arms and interact with the threads, retaining the threads to be knotted therebetween. The braking action overcomes the pressure exerted against the threads by the lifting arms of the knotting apparatus and retains the threads in position until the threads are released from the binding heads and a tight knot is formed therein.

6 Claims, 7 Drawing Figures

THREAD INSERTER AND BRAKING MECHANISM FOR A KNOTTING APPARATUS USED ON SPOOLING MACHINES

BACKGROUND OF THE INVENTION

1. Field of the Invention

The present invention relates to thread inserting and braking mechanisms for knotting apparatuses, and more particularly to a mechanism which inserts the threads into a knotting apparatus and cooperates with a braking mechanism to retain the threads therein when the threads are acted upon by the thread lifting mechanism.

2. Description of the Prior Art

In practice, a plurality of spooling machines are placed in close proximity to each other. Generally, one knotting apparatus is utilized for a plurality of these machines and is moved from one machine to another as required. The present invention is utilized on a knotting apparatus of this type, which services a bank of spooling machines. The knotting apparatus and thread inserter and braking mechanism of the present invention is affixed to a spooling machine, operatively coupled thereto and derives its energy for operation from a backwardly and forwardly moving shaft provided therein.

The knotting apparatus of the present invention provides a fisherman's knot, which includes two loops formed separate from each other with the remaining thread ends cut off. The loops are then pulled together to form a knot. In order to obtain adequate cutting pressure, the thread ends are clamped in binding heads which also include the cutting mechanisms. Thread lifters provide the appropriate thread tension which pull the loops together and form a tight knot.

Prior art knotting mechanisms form loops on both binding heads and the threads are clamped therein in order to enable them to be severed. The arms of the thread lifting mechanism, located on the side of the binding heads, provide sufficient thread tension to pull the loops tight on the binding head and thereafter remove them therefrom. In providing the tension while the threads are on the binding heads and thereafter pulling the threads off, an undesirable knotting effect occurs, particularly in soft threads, in the area of the loops. This knotting or tangling effect is so undesirable that tensioning the thread to form the finished knot generally causes thread breakage. In some cases, it merely prevents the knot from being tightened so that an unreliable knot is formed. This is detected by a thread tester, in the further operation of the spooling machine, and the thread is caused to be cut and re-knotted.

In other known knotting devices, the loop is formed in a relatively loose fashion on the binding heads. With this type of knotting mechanism, a specially driven and specially steered thread lifter disposed between the binding heads is used to remove the clamped threads therefrom in order that they may be pulled together thereafter by the two arms of another thread lifter disposed outside of the binding heads. However, this requires a specially driven and steered thread lifter located between the two binding heads and generates longer thread ends on a finished knot.

The present invention overcomes the shortcomings of the prior art by providing a thread inserter and braking mechanism which is provided with a pair of arms disposed external to and on either side of the binding heads and operates in combination with a pair of thread brake pads and a thread lifter, which has a pair of arms disposed on either side of the binding heads, thereby permitting the thread loops to be removed from the binding heads at the same time the threads are firmly pulled together.

SUMMARY OF THE INVENTION

In a knotting apparatus for spooling machines having, a housing affixed to said spooling machine and operatively coupled thereto, thread lifting means, thread guides, and a pair of binding heads, the improvement comprises, according to the principles of the present invention, a thread inserter and braking means having a pair of arms disposed external to and on either side of the housing means and operatively coupled to the spooling machine, the thread inserter and braking means inserting a pair of threads, by interacting therewith and exerting a pressure thereagainst, into said thread guides; and braking means disposed on either side of the housing for cooperating with the thread inserting and braking means and retaining the thread therebetween overcoming pressure exerted against the threads by the lifting means until the threads are released from the binding heads and the threads are tightly knotted.

BRIEF DESCRIPTION OF THE DRAWINGS

In order that the invention may be more fully understood, it will now be described, by way of example, with reference to the accompanying drawings in which.

DESCRIPTION OF THE PREFERRED EMBODIMENT

Figure 1:
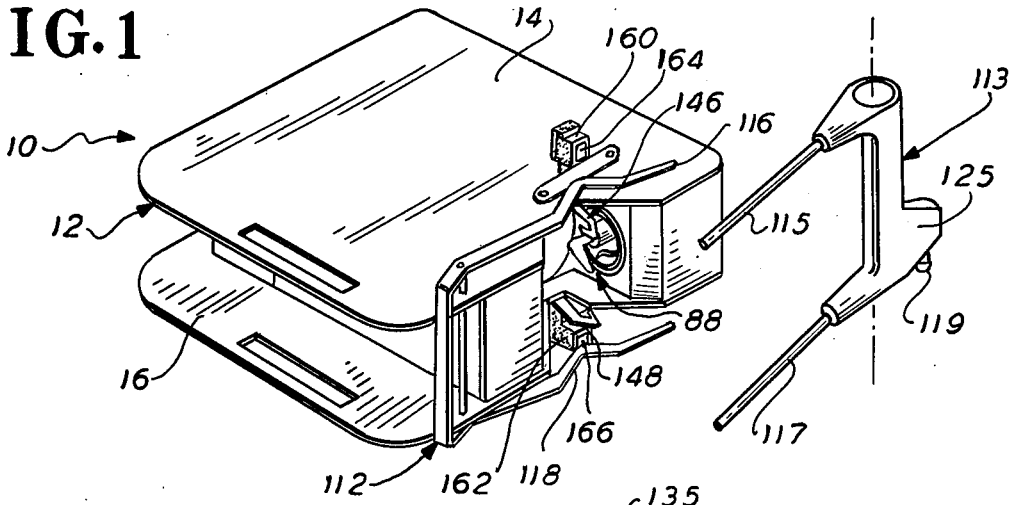
FIG. 1 is a perspective view of a thread inserter and braking mechanism for a knotting apparatus, according to the principles of the present invention.

Referring now to the figures, and in particular to FIG. 1 which shows a perspective view of the knotting apparatus 10, which includes a thread lifting mechanism 112 having a pair of arms 116 and 118, a thread inserter and braking mechanism 113 having a pair of arms 115 and 117, a pair of resilient brake blocks 160 and 162 having disposed thereon a sheet of hard material 164 and 166, respectively, a pair of thread guides 146 and 148, and a pair of binding heads 88 and 98 (only one being in view), all of which are included in a housing 12 which includes side walls 14 and 16, and spacer blocks 74 and 90.

A typical knotting apparatus for spooling machines may be found in co-pending U.S. patent application Ser. No. 940,766 filed contemporaneously herewith by the applicant hereof, and is hereby incorporated in its entirety herein.

Figure 2:
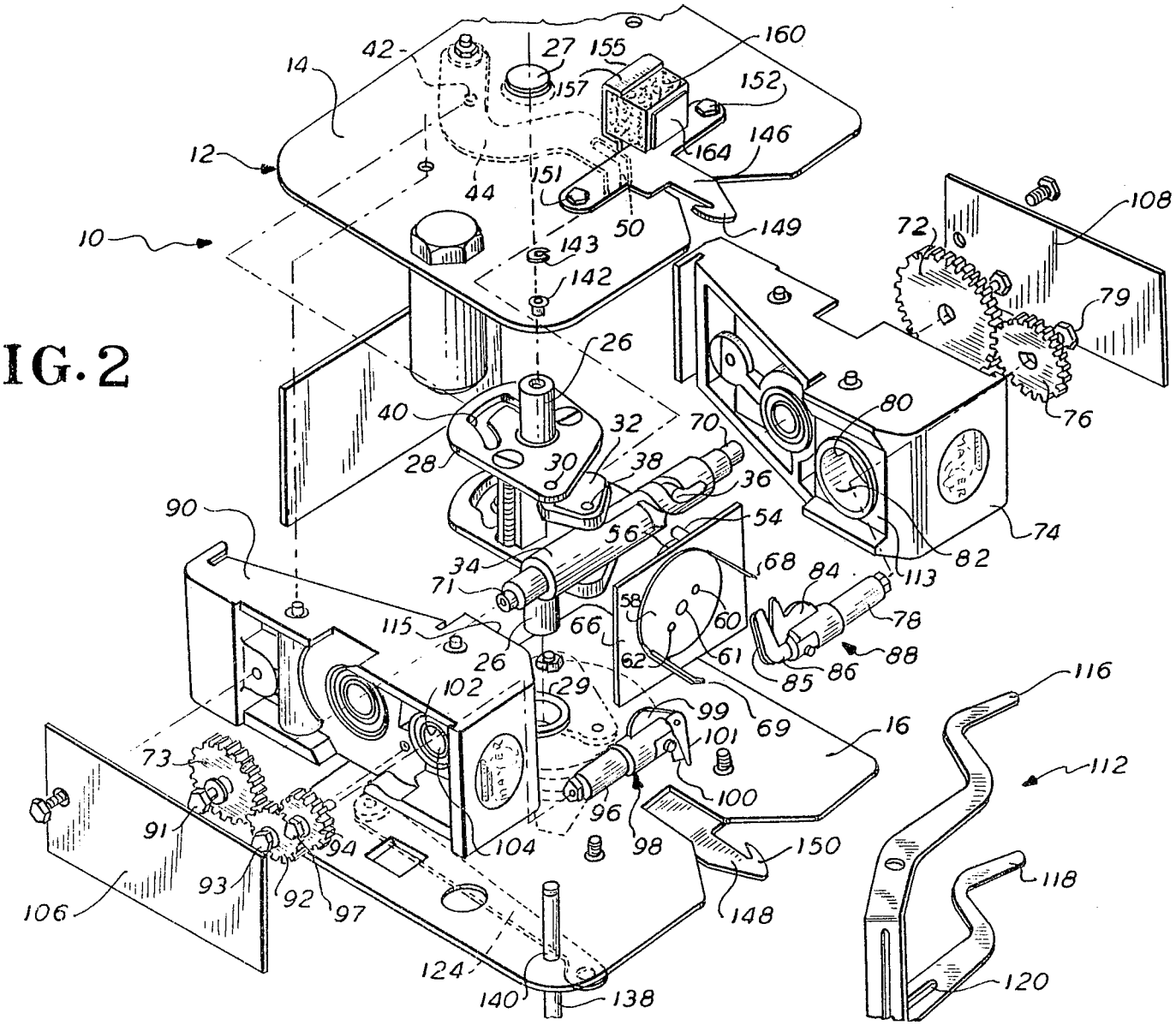
FIG. 2 is an exploded view of the knotting apparatus and thread inserter and braking mechanism shown in FIG. 1.
Figure 3:
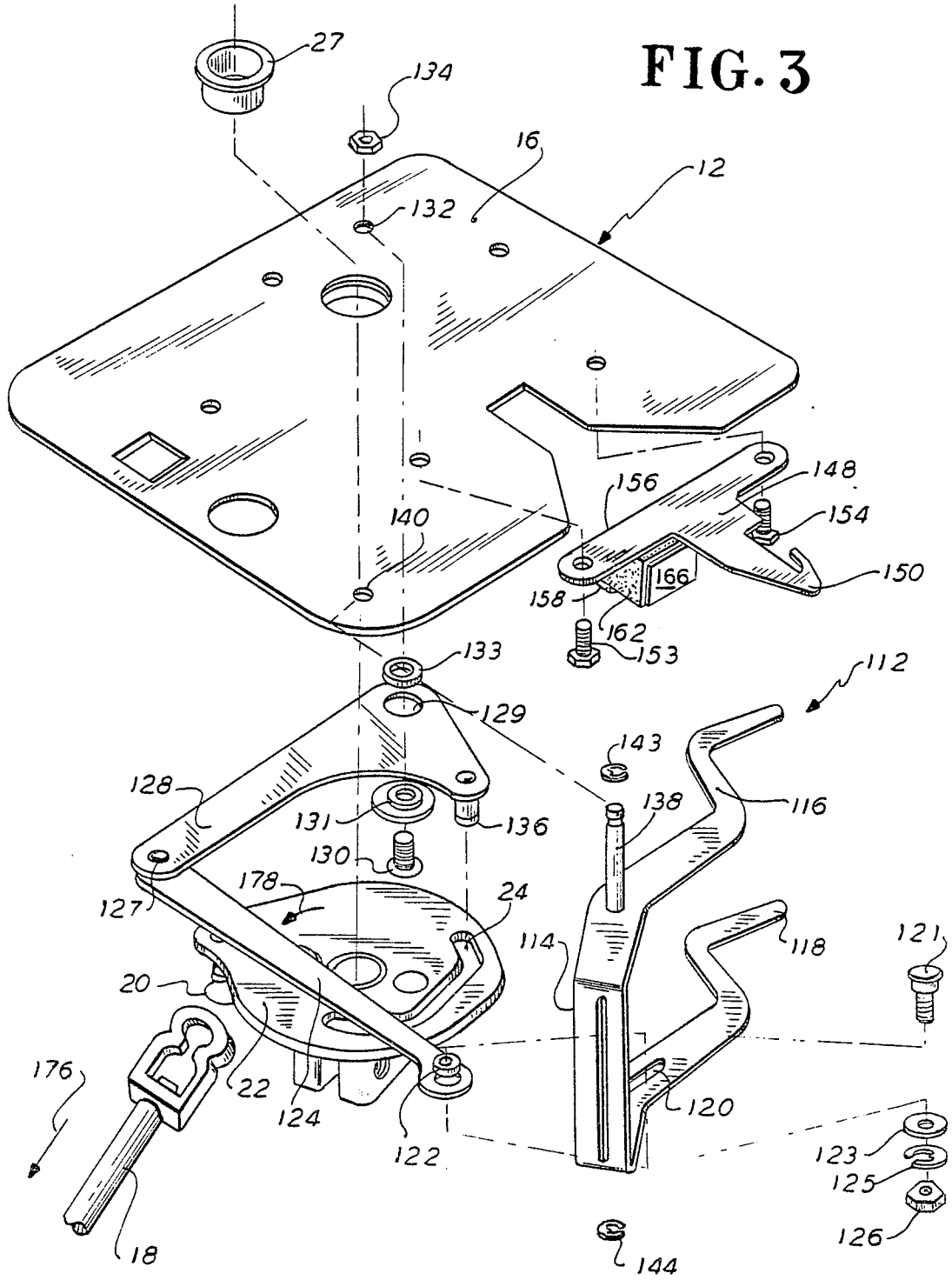
FIG. 3 is an exploded view of the underside of the apparatus shown in FIG. 2.

FIGS. 2 and 3 are an exploded view of the knotting apparatus utilized in combination with the thread inserter and braking mechanisms of the present invention. The knotting apparatus 10 is affixed to a spooling machine, not shown, in a conventional manner. The knotting apparatus may be considered to be divided into the knotting mechanisms, the elements which cooperate with each other and interact with the threads to form the actual knot and the driving linkages, which are coupled to the knotting mechanisms and activate and rotate the knotting mechanisms in proper sequence so that the threads applied to the knotting mechanisms may readily be knotted together. In the preferred embodiment, it will be seen that the knotting mechanisms and driving linkages therefore are disposed separate and apart from one another although coupled together. The advantages of such construction are obvious and include the ability for lubricating the driving linkages while in operation without affecting the knotting mechanisms or causing any of the lubrication to affect the threads. The sectionalization will become apparent as each of the elements are described in detail.

The knotting apparatus 10 is provided with a housing 12 which includes side walls 14 and 16. External to the housing 12, a drive shaft 18 (FIG. 3) is operatively coupled on one end to a spooling machine, not shown. The other end of the drive shaft 18 is journaled on an eccentric pivot 20 provided on drive disc 22. Drive disc 22 is provided with a channel or groove 24 whose function will be described hereinafter. Drive shaft 18 is provided with forward and backward motion from the spooling machine thereby imparting rotary motion to drive disc 22. The drive disc 22 is affixed to a drive shaft or spindle 26 in a conventional manner.

Also coupled to the spooling machine is the thread inserter and braking mechanism 113 which includes a pair of parallel arms 115 and 117 which extend in a direction opposite to and parallel with the arms 116 and 118 of thread lifting mechanism 112. The arms 115 and 117 are external to the side walls 14 and 16 of housing 12 and are adapted to cooperate with the brake blocks 160 and 162. The driving of the thread inserter and braking mechanism 113 is accomplished by a drive shaft, not shown, coupled to drive pin 119 disposed on an extending portion 125 of mechanism 113.

A pair of drive cams 28 are provided on the drive shaft 26. The drive shaft 26 is journaled in the housing walls 14 and 16 by means of oilite bearings 27 and 29 provided therein. A pair of drive pins 30 are provided in the extending portions of drive cams 28. Drive pins 30 are adpated to be received by and cooperate with lever or lever plate 32 which is generally U-shaped and surrounds a drive spindle 34 which is provided with a spirally shaped channel or groove 36. Groove 36 is adapted to slidably receive drive pin 38 therein. Drive pin 38 is affixed at both ends in U-shaped lever plate 32 thereby providing rigid and controlled motion of the guide pin in the groove 36.

Drive cam 28 is provided with a groove or channel 40 which is adapted to receive and cooperate with pin 42 provided in lever 44. The lever 44 is provided with an aperture 46 at one end thereof. Aperture 46 is adapted to be mounted onto pivot 48 therby permitting the to and fro motion of lever 44. The opposite end of lever 44 is provided with a slot 50 which extends into the end portion 52 of lever 54. End portion 52 is bent at right angles to the remainder of lever 44.

Slot 50 is adapted to receive pin 54 provided in the underside portion 56 of crosser plate 58. Crosser plate 58 and the underside portion 56 thereof are held together by pins or rivets 61, 62 and 63 on either side of the shelf or wall 66 provided in the housing 12. Thus, to and fro motion of lever 44 will cause back and forth rotary motion of the crosser plate 58. A pair of crossing arms 68 and 69 are affixed to the crosser plate 58 and extend upwardly therefrom at 90 degrees.

The ends 70 and 71 of drive spindle 34 have affixed thereon, in a conventional manner, gears 72 and 73, respectively. The end 70 of drive spindle 34 is journaled in a molded spacer block 74 to which wall plates 14 and 16 are affixed in a conventional manner. The end 70 of drive spindle 34 extends through spacer block 74 with gear 72 meshing with another gear 76 affixed to the end of binding head shaft 78 by means of a screw 79. Shaft 78 rotates in aperture 80 which is provided with an internal eccentric caming surface 82. The eccentric caming surface 82 cooperates with a pivotal gripping and cutting blade 84 which in turn cooperates with blades 85 and 86 on a binding head 88. Thus, rotation of the gear 76 will cause binding head 88 to rotate and will activate the cutting and gripping blade 84 because of the eccentricity of caming surface 82.

End 71 of drive spindle 34 is journaled in spacer block 90 and extends therethrough with gear 73 being affixed thereon by means of a screw 91. Gear 73 intermeshes with idler gear 92 which is journaled on screw 93 mounted in spacer block 90. Idler gear 92 meshes with gear 94 mounted on binding head shaft 96 by means of a screw 97. Binding head shaft 96 of binding head 98 is identical with binding head 88 and includes cutter blade 99 and gripping blades 100 and 101. Binding head 98 rotates in aperture 102 provided in spacer block 90 which is also provided with an eccentric caming surface 104 which cooperates with blade 99 and causes the movement thereof when the binding head is rotated. Since the drive spindle 34 is coupled to the binding head 98 via three gears 73, 92 and 94 on one end whereas it is coupled to binding head 88 and two gears 72 and 79 at the other end, the rotation of the binding heads 88 and 98 will be in opposite directions. Binding heads 88 and 98 are journaled in a wall which is extending at an angle of 90 degrees from the shelf or wall 66 and face each other.

Cover plates 106 and 108 may be used to cover the gears 73, 92 and 94 and gears 72 and 76, respectively, permitting the use of heavy lubrication thereof without coming into contact with the threads, not shown.

It is also to be noted, that the section of the knotting apparatus 10 that houses the drive shaft 26, drive cams 28, lever plate 32, drive spindle 34 and drive pin 38 may be heavily lubricated without affecting the knotting mechanisms appearing in the knotting mechanism compartment 110 delineated by crosser plate 58, walls 112 and 114 of spacer blocks 74 and 90, respectively, and side walls 14 and 16.

Referring now to FIG. 3, which shows an exploded view of the thread lifting mechanism 112 which is affixed on the underside of side wall 16 of the housing 12. The thread lifting mechanism 112 includes U-shaped bracket 114 which is provided with curved arms 116 and 118. Arm 118 is provided with a slot 120 which is adapted to receive screw 121 therein with spacer 122 permitting free movement of lever 124 when tightened into position in slot 120 by means of flat washer 123, block washer 125 and nut 126. The opposite end of lever 124 is provided with a shoulder rivet 126 which permits L-shaped bracket 128 to move freely. L-shaped bracket 128 is provided with an aperture 129 at the apex thereof.

A screw 130 is adapted to be inserted into a shoulder washer 131 which in turn is inserted into aperture 129 which is in turn inserted into aperture 132 provided in wall 16 with a spacer washer 133 disposed therebetween. A nut 134 placed over screw 130 holds the assembly in position and functions as a pivot point for bracket 128. At the remaining extremity of bracket 128, a guide pin 136 is provided. Guide pin 136 of bracket 128 is adapted to slidably engage channel 24 of drive disc 22.

Bracket 114 is provided with a pair of apertures adapted to receive spacer pin 138 which is adapted to mount into aperture 140 in wall 16 and aperture 142 in wall 14 (FIG. 2). A pair of C-retainers 143 and 144 placed over the ends of spacer pin 138 retains it in position permitting free movement of the U-shaped bracket 114. Thus, rotation of disc 22 will cause arms 116 and 118 to be raised at the proper time.

Additionally included on the outer surfaces of walls 14 and 16 are thread guides 146 and 148, respectively. The thread guides 146 and 148 are provided with a hook shaped portion 149 and 150, respectively, which guide the threads into proper position. The thread guides 146 and 148 are affixed to the walls 14 and 16 by means of screws 151, 152, 153 and 154, respectively. Thread guides 146 and 148 are provided with a portion thereof 155 and 156, respectively, which extend outwardly at approximately right angles to the main portion of the thread guides. In addition, a lip is provided on the outwardly extending portions 155 and 156. The lips 157 and 158, provided on guides 146 and 148 are used to position resilient, preferably rectangular shaped brake blocks 160 and 162. The brake blocks 160 and 162 are glued to the outwardly extending portions 155 and 156, respectively, in a conventional manner. The opposite face of the resilient brake blocks 160 and 162 are provided with a sheet 164 and 166 of relatively hard material. The sheet covers the exposed surface of the brake blocks 164 and 166 that is perpendicular to the thread guides 146 and 148. When the arms 116 and 118 are in their lowermost position, they enter an open space between the resilient brake blocks 160 and 162 and the thread guides 146 and 148. A pair of braking arms 115 and 117 cooperate with brake blocks 164 and 166 thereby clamping threads inserted therebetween during knotting.

Figure 4:
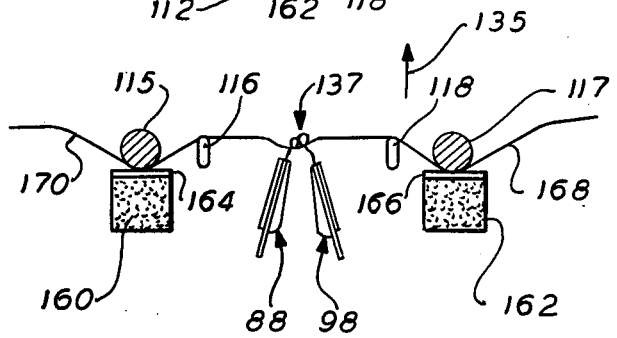
FIGS. 4, 5 and 6 are pictorial representations of the knot-forming mechanisms including the position of the thread inserter and braking mechanism and brake pads at various points in the knotting cycle.
Figure 5:
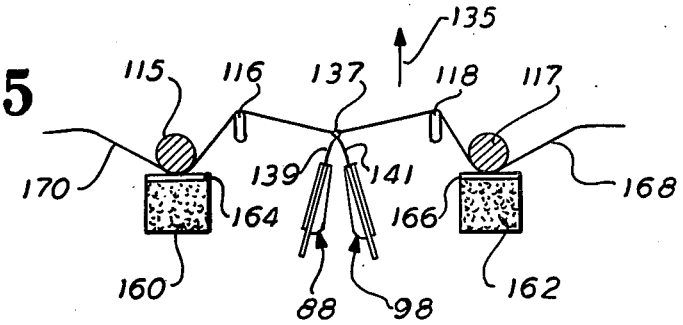
Figure 6:
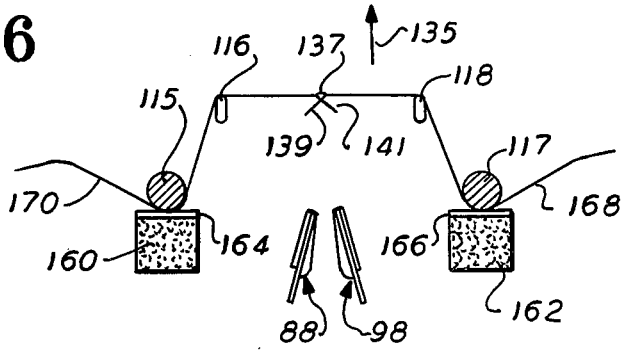

Referring now to FIGS. 4, 5 and 6 which show various stages of the knotting mechanism. As shown in FIG. 4, the knot formation by the binding heads 88 and 98 has already been accomplished. The thread lifter arms 116 and 118 have already started their upward movement in the direction of arrow 135, have removed the loosely formed loops from the binding heads 88 and 98, and, at the same time, have pulled the loops together to form a knot 137. The thread tension occurs because the pair of thread inserter and braking arms 115 and 117 cooperate with the brake blocks 160 and 162, with hard material 164 and 166 on its upper surface, to clamp threads 170 and 168, respectively, therebetween. As the knotting mechanism progresses, as shown in FIG. 5, the thread lifters 116 and 118 continue in their upward direction. The already formed knot 137 whose clamped thread segments are held down by the thread inserter and braking arms 115 and 117 are further pulled into a tight knot with the thread ends 139 and 141 thus kept comparatively short and are still held by the binding heads 88 and 98, respectively. The knotting process continues, as shown in FIG. 6, by the further upward movement of arms 116 and 117 of the thread lifting mechanism 112. The thread ends 139 and 141 are pulled out of the binding heads 88 and 98 just after they are severed by the cutting mechanism therein.

It is to be noted that in this arrangement the thread ends 139 and 141 are securely held by the binding heads 88 and 98, respectively, simultaneously with the arms 115 and 117 of the thread inserter and braking mechanism 113 cooperating with brake blocks 160 and 162 so that the thread tension is increased a sufficient amount to permit the removal of both loops from the binding heads at the same time as they are pulled together to form a knot. The final pulling together or tightening of the knot 137 is shown in FIG. 6 as arms 116 and 118 continue their upward movement while remaining clamped by the arms 115 and 117 and brake blocks 160 and 162.

Figure 7:
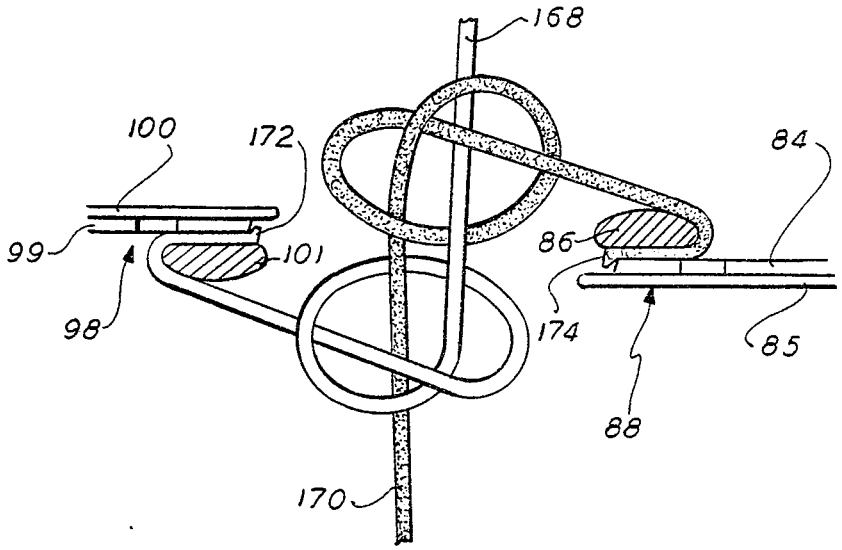
FIG. 7 shows the knot formed with two threads just prior to removal from the binding heads.

FIG. 7 discloses the configuration of two threads 168 and 170 that have been fed into the thread guides 148 and 140 and been permitted to complete a knotting cycle. The thread ends 172 and 174 are cut prior to removal from the knotting apparatus.

In operation, the threads 158 and 170 are fed into the open portion of thread guides 148 and 149 by the arms 115 and 117 of the thread inserter and braking mechanism 113. The thread lifting mechanism 112 is in its lowermost position at the start of the cycle. The braking arms 115 and 117 hold the threads against the brake block surfaces 164 and 166. As drive shaft 18 is moved in direction of arrow 176, drive disc 22 is caused to rotate in the direction of arrow 178, causing thread lifting mechanism 112 to be raised. The braking arms 116 and 117 clamp the threads to the brake blocks 160 and 162, respectively. Rotation of drive spindle 34 is also started causing rotation of the binding heads 88 and 98. With continual movement in the direction of arrow 176 of drive shaft 18, drive pin 38 is caused to move in channel 36 and apply a rotary motion to the binding heads, via gears 72 and 76 and gears 73, 92 and 94. Rotation of the crosser plate 58 and the arms 68 and 69 associated therewith, is accomplished by the movement of lever 44 which is moved by the rotation of drive shaft 26 when guide pin 42 follows the channel 40 in drive cam 28. Thus, the complete sequence of events are provided in timed sequence so that the knot shown in FIG. 7 may occur between threads 168 and 170.

Hereinbefore it has been disclosed a thread inserter and braking mechanism for a knotting apparatus used on spooling machines which provides a means for tying a reliable tight knot having short ends. It will be understood that various changes in the details, materials, arrangement of parts and operating conditions which have been herein described and illustrated in order to explain the nature of the invention can be made by those skilled in the art within the principles and scope of the present invention.

Having thus set forth the nature of the invention, what is claimed is:

1. In a knotting apparatus for spooling machines having, a housing affixed to said spooling machines and operatively coupled thereto, thread lifting means, thread guides, and a pair of binding heads, the improvement comprising:

(a) thread inserter and braking means having a pair of arms disposed external to and on either side of said housing means perpendicular to the run of the threads and operatively coupled to said spooling machine, said thread inserter and braking means inserting a pair of threads by interacting therewith and exerting a pressure thereagainst, into said thread guides; and (b) braking means disposed on either side of said housing for cooperating with said thread inserter and braking means and retaining said thread therebetween overcoming pressure exerted against said threads by said lifting means until said threads are released from said binding heads and the threads are tightly knotted.

2. In a knotting apparatus according to claim 1 wherein the arms of said inserter and braking means are disposed on either side of said thread lifting means.

3. In a knotting apparatus according to claim 2 wherein said thread lifting means includes a pair of arms for releasing the threads from said binding heads at essentially the same time.

4. In a knotting apparatus according to claim 2 wherein said lifting means includes a pair of arms for releasing the threads from said binding heads and a pulling together of the thread loops occurring at essentially the same time.

5. In a knotting apparatus according to claim 1 wherein said braking means is a resilient material.

6. In a knotting apparatus according to claim 1 or 5 wherein said braking means includes a pad of resilient material and a relatively hard material affixed to the surface thereof in contact with said threads.

* * * * *